United States Patent [19]

Takahashi

[11] Patent Number: 4,897,966

[45] Date of Patent: Feb. 6, 1990

[54] POLISHING APPARATUS

[75] Inventor: Yutaka Takahashi, Noda, Japan

[73] Assignees: Japan Silicon Co., Ltd.; Mitsubishi Kinzoku Kabushiki Kaisha, both of Tokyo, Japan

[21] Appl. No.: 87,167

[22] Filed: Aug. 18, 1987

[30] Foreign Application Priority Data

Aug. 19, 1986 [JP] Japan ..... 61-193781
Dec. 4, 1986 [JP] Japan ..... 61-289446

[51] Int. Cl.[4] ..... B24B 37/04

[52] U.S. Cl. ..... 51/131.3; 51/131.5; 51/237 R

[58] Field of Search ..... 51/131.3, 131.4, 131.5, 51/277, 240 T, 240 GB, 283 R, 237 R, 217 R

[56] References Cited

U.S. PATENT DOCUMENTS

| | | | |
|---|---|---|---|
| 2,441,108 | 5/1948 | Turner | 51/216 LP |
| 3,579,917 | 5/1971 | Boettcher | 51/131.4 |
| 3,740,900 | 2/1973 | Youmans et al. | 51/235 |
| 3,849,948 | 4/1974 | Youmans et al. | 51/310 |

FOREIGN PATENT DOCUMENTS

| | | | |
|---|---|---|---|
| 0156746 | 6/1985 | European Pat. Off. . | |
| 2252503 | 5/1974 | Fed. Rep. of Germany | 51/131.4 |
| 2132174 | 7/1974 | Fed. Rep. of Germany . | |
| 208576 | 4/1984 | German Democratic Rep. . | |
| 0743850 | 6/1980 | U.S.S.R. | 51/131.3 |

OTHER PUBLICATIONS

A. C. Bonora, "Flex-Mount Polishing of Silicon Wafers", Solid State Technology, Oct. 1977, pp. 55–58.

Patent Abstracts of Japan, vol. 1, No. 68, 4th Jul. 1977, p. 1023 M 77.

*Primary Examiner*—Robert Rose

*Attorney, Agent, or Firm*—Cushman, Darby & Cushman

[57] ABSTRACT

An apparatus for polishing one of opposite faces of a slab member includes a surface plate, a mounting member, an urging shaft and a pressure transmitting member. The surface plate has a flat upper surface and is rotatable about an axis perpendicular to the upper surface. The mounting member has an upper face and a lower face to which the other face of the slab member is fixedly secured, and is disposed above the surface plate in such a manner that the one face of the slab member to be polished is held in contact with the upper surface of the surface plate. The urging shaft is connected to the mounting member for urging the mounting member toward the surface plate at a prescribed urging pressure to bring the one face of the slab member into pressure contact with the upper surface of the surface plate. The pressure transmitting member is interposed between the mounting member and the urging shaft for causing the urging pressure of the urging shaft to exert on the upper face of the mounting member. The transmitting member has a deformable chamber which contains a fluid therein.

2 Claims, 4 Drawing Sheets

POLISHING APPARATUS

BACKGROUND OF THE INVENTION

1. Field of the Invention

The present invention relates to an apparatus for polishing a face of a slab member such as a silicon wafer.

2. Prior Art

Generally, a silicon wafer has been used as a semiconductor substrate for an integrated circuit or a large scale integrated circuit, and one face thereof has been subjected to specular polishing.

FIGS. 1 to 3 of the accompanying drawings show a conventional apparatus employed for such polishing. The apparatus includes a circular rotary surface plate 100, a plurality of mounting heads 102 disposed above the surface plate 100 in circumferentially spaced relation to one another, and a plurality of mounting plates 104 each disposed between a respective one of the mounting heads 102 and the surface plate 100. The surface plate 100 has a polishing pad 100*a* attached to an upper face thereof. Each mounting head 102 has a circular recess formed in a lower surface thereof, and a shaft 106 is connected to an upper surface of the mounting head 102 at its central portion. Driving means such as a hydraulic cylinder 107 is operably connected to the shaft 106 for causing the mounting heads 102 to move downwardly. Each mounting head 102 is rotatable about and inclinable with respect to the shaft 106. Each mounting plate 104 is made of ceramics, glass material or the like, and has flat opposite surfaces. Each mounting plate 104 is received in the recess of a respective one of the mounting heads 102 with its upper surface being held in contact with an inner planar face of the recess. And, one or more silicon wafers 108 are fixedly secured to the lower surface of each mounting plate 104 with one face of each wafer held in contact with the lower surface of the mounting plate. The silicon wafers 108 may be fixedly secured to the lower surface of the mounting plate 104 by wax applied to the lower surface of the mounting plate 104. Otherwise, the wafers may be secured by means of vacuum adsorption or water adhesion method making use of surface tension.

For polishing the silicon wafers 108 by using such apparatus, a liquid abrasive such as alkaline suspension of a colloidal silica is first poured on the flat upper surface of the surface plate 100. Next, the mounting plates 104 to which the silicon wafers 108 have been fixedly secured are disposed above the surface plate 100 in such a manner that the silicon wafers are interposed between the surface plate 100 and the mounting plates 104, and that that face of each wafer to be polished is brought into contact with the polishing pad of the surface plate 100. Thereafter, the mounting heads 102 as well as the mounting plates 104 are caused to move downwardly by the driving means to urge the silicon wafers 108 onto the upper flat surface of the surface plate 100, following which the surface plage 100 is rotated. Thus, the lower surface of each silicon wafer 108 is polished by the abrasive poured on the upper surface of the surface plate 100.

In the foregoing, the velocity of relative movement of the silicon wafer 108 against the surface plate 100 is greater when the silicon wafer is held in contact with that inner surface portion of the surface plate 100 adjacent to its axis of rotation than when it is held in contact with an outer surface portion thereof. For this reason, among those silicon wafers secured to the same mounting plate, that silicon wafer held in contact with the outer portion of the surface plate 100 is dragged by the rotation of the surface plate 100, so that the mounting plate 104 as well as the mounting head 102 is caused to rotate in the same direction as that in which the surface plate 100 rotates.

The conventional polishing apparatus, however, involves a problem in that it is difficult to polish each silicon wafer so as to have a uniform thickness. Namely, when polishing a silicon wafer by the above apparatus, polishing resistance is exerted between the silicon wafer and the surface plate 100 to cause the mounting plate 104 to be tilted upwardly in the direction of rotation of the surface plate 100 with respect to the shaft 106. A moment defined by a multiplication of the polishing resistance and the height of the lower end of the shaft 106 from the surface plate 100 will be increased if the height of the lower end of the shaft 106 is large, with the result that an inclination of the mounting plate 104 is increased and hence the polished surface of the silicon wafer becomes inclined. Accordingly, the thickness of the wafer thus polished has not been uniform. Further, when the opposite faces of the mounting plate 104 are not parallel to each other, or when the contact surfaces between the mounting head 102 and the mounting plate 104 are undulatory, the urging force transmitted through the mounting head 102 has been exerted unevenly on the entire surface of the mounting plate 104. Consequently, the wafers 108 secured to the mounting plate are caused to be pressed ununiformly against the surface plate 100, resulting in uneven thickness of the wafer.

SUMMARY OF THE INVENTION

It is therefore an object of the present invention to provide a polishing apparatus in which a wafer secured to a mounting plate is uniformly urged toward a surface plate even though a mounting head has an undulatory lower surface or opposite faces of the mounting plate are not exactly parallel to each other, and in which a fulcrum of a moment exerted on the mounting plate is disposed nearer to the surface plate to reduce the moment, thereby permitting the wafer to be polished to have a uniform thickness.

According to the present invention, there is provided an apparatus for polishing one of opposite faces of a slab member comprising a surface plate having a flat upper surface and being rotatable about an axis perpendicular to the upper surface, a mounting member having an upper face and a lower face to which the other face of the slab member is fixedly secured, the mounting member being disposed above the surface plate in such a manner that the one face of the slab member to be polished is held in contact with the upper surface of the surface plate, urging means operably connected to the mounting member for urging the mounting member toward the surface plate at a prescribed urging pressure to bring the one face of the slab member into pressure contact with the upper surface of the surface plate, and pressure transmitting means interposed between the mounting member and the urging means for causing the urging pressure of the urging means to exert on the upper face of the mounting member, the transmitting means comprising a deformable chamber which contains a fluid therein.

DESCRIPTION OF THE PREFERRED EMBODIMENTS OF THE INVENTION

Figure 4:
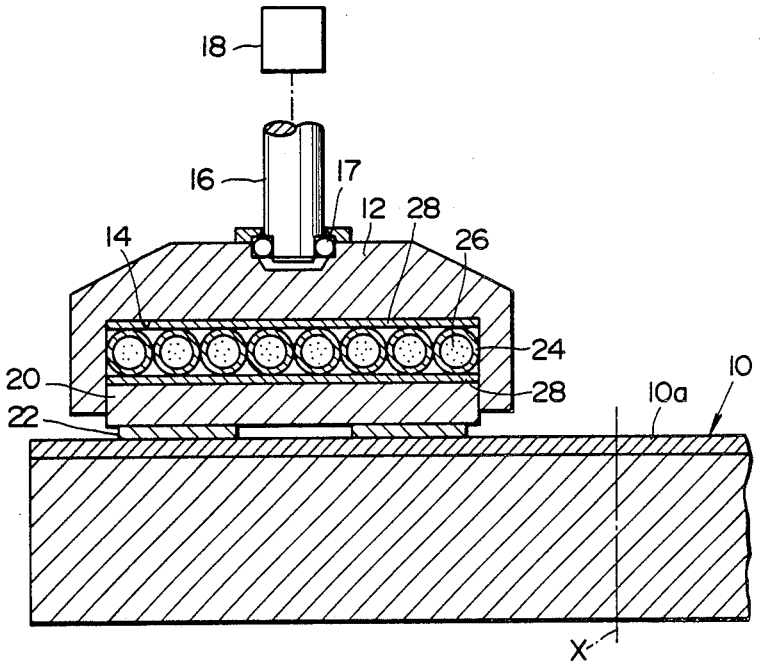
FIG. 4 is a sectional view of a part of a polishing apparatus in accordance with one embodiment of the present invention.
Figure 5:
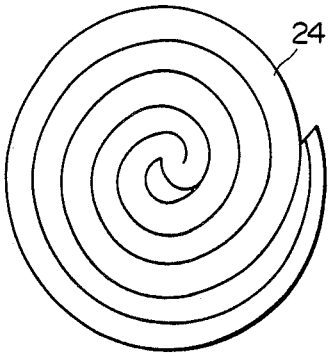
FIG. 5 is a plan view of a resilient tube used in the apparatus of FIG. 4.

Referring to FIGS. 4 and 5, there is illustrated a first embodiment of a polishing apparatus in accordance with the present invention, in which a reference numeral 10 indicates a circular rotary surface plate which has a polishing pad 10*a* attached to an upper face thereof. A plurality of mounting heads 12 are disposed above the surface plate 10 in circumferentially spaced relation to one another. Each mounting head 12 is composed of a circular member having a circular recess 14 formed in a lower surface thereof, and a shaft 16 is connected to an upper surface of the mounting head 12 at its central portion through a self-aligning bearing 17 in such a manner that the mounting head 12 is rotatable about and inclinable with respect to the shaft 16. Driving means 18 such as a hydraulic cylinder and a pneumatic cylinder is operably connected to the mounting heads 12 through the shafts 16 for causing the mounting heads 12 to move downwardly. A plurality of mounting members or plates 20 each made of ceramics, glass material or the like are disposed on the surface plate 10. Each mounting plate 20 has flat opposite surfaces, and is received in the recess 14 of a respective one of the mounting heads 12. And, one or more silicon wafers 22 are fixedly secured to the lower surface of each mounting plate 20 with one face of each wafer 22 held in contact with the lower surface of the mounting plate 20 in a conventional manner.

Disposed between each mounting plate 20 and each mounting head 12 is a resilient tube 24 which contains a fluid 26 therein and has opposite ends closed. The fluid may be a liquid such as water and oil, or may be a gas such as air and nitrogen. The resilient tube 24 is wound in a vortical form, and includes thin resilient plates or seats 28 are fixedly secured to upper and lower sides thereof by pressure sensitive adhesive double coated tapes or the like. The resilient tube 24 is housed in the recess 14 of the mounting head 12 with an upper surface of the upper resilient seat 28 being held in contact with an inner planar face of the recess 14 while a lower surface of the lower resilient seat 28 held in contact with the upper face of the mounting plate 20. The upper surface of the upper resilient plate 28 may be fixedly secured to the inner planar face of the recess 14 by a pressure sensitive adhesive double coated tape or the like.

Figure 1:
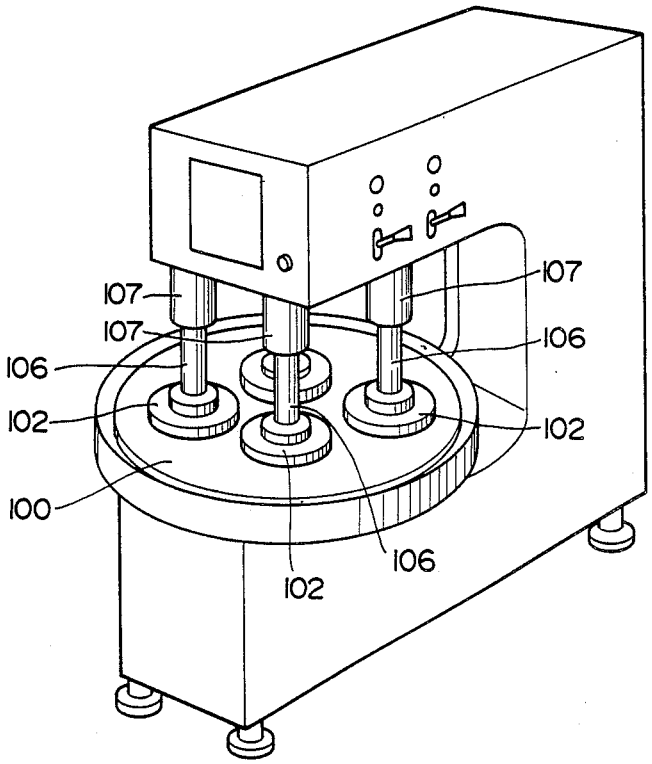
FIG. 1 (PRIOR ART)
FIG. 1 is a schematic perspective view of a conventional polishing apparatus.
Figure 2:
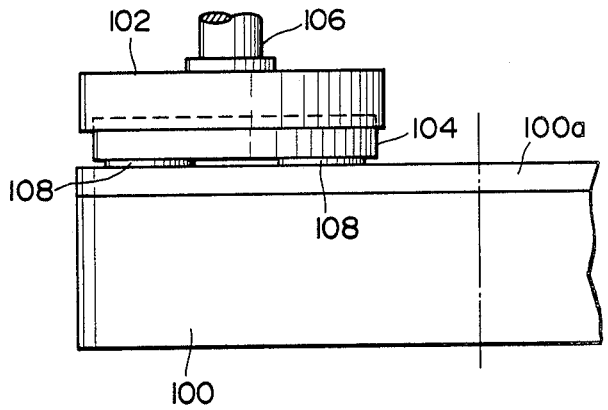
FIG. 2 (PRIOR ART)
FIG. 2 is a fragmentary side view of a part of the apparatus of FIG. 1.
Figure 3:
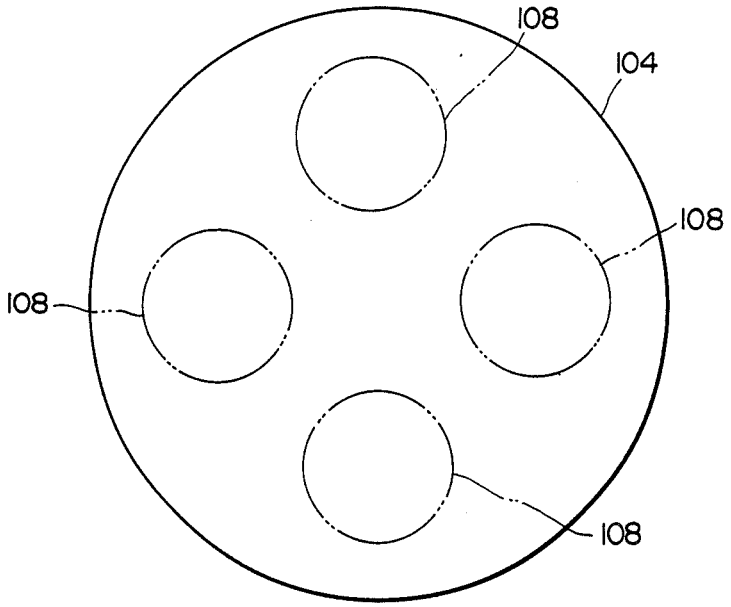
FIG.3 (PRIOR ART)
FIG. 3 is an enlarged bottom view of a mounting plate of the apparatus of FIG. 1, but showing the disposition of silicon wafers.

For polishing the silicon wafers 22, the polishing apparatus is first set as shown in FIG. 3, and the driving means 18 is operated to move the shafts 16 downwardly to urge the mounting heads 12 downwardly. Then, each resilient tube 24 is pressed and urged downwardly against the upper surface of a respective one of the mounting plates 20 through the resilient tube 24 to press the silicon wafers 22 secured to the lower face of a respective mounting plate 20 against the upper surface of the surface plate 10. Subsequently, the surface plate 10 is caused to rotate about an axis X thereof. At that time, the mounting plates 20 are respectively rotated in the same direction as the surface plate 10 rotates, and the lower faces of the silicon wafers 22 are subjected to polishing respectively.

In the polishing apparatus as described above, since the resilient tube 24 containing therein the fluid 26 is interposed between each mounting head 12 and each mounting plate 20, the urging pressure exerted on the mounting head 12 is transmitted to the mounting plate 20 uniformly over the entire surface thereof to urge the wafers 22 against the upper surface of the surface plate 10 in such a manner that the urging pressure exerted on each wafer 22 becomes uniform over the entire upper face of the wafer 22. Accordingly, when the above apparatus is used, wafers 22 each having a uniform thickness can be obtained.

In addition, inasmuch as the apparatus in accordance with the above embodiment is similar in structure to the prior art apparatus except that each resilient tube 24 is disposed between the mounting plate 20 and the mounting head 12, the prior art apparatus can easily be modified to the apparatus in accordance with the present invention, and besides it is comparatively easy to manufacture such an apparatus.

Figure 6:
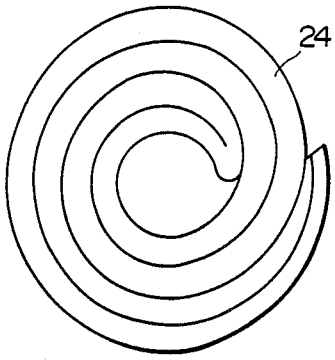
FIG. 6 is a view similar to FIG. 5, but showing a modified resilient tube.

In the foregoing, the resilient tube 24 may be of a doughnut shape, as shown in FIG. 6, since no silicon wafer is disposed in the vicinity of the center of the mounting plate 20.

Figure 7:
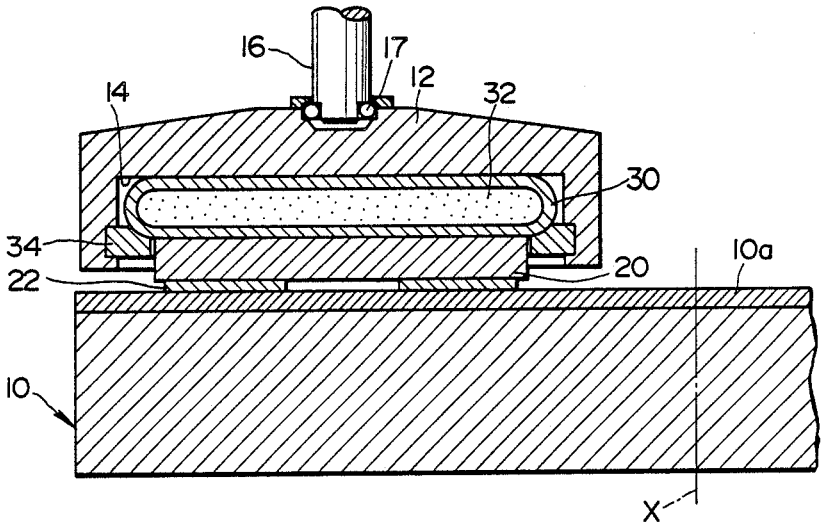
FIG. 7 is a view similar to FIG. 4, but showing a modified polishing apparatus in accordance with the present invention.

FIG. 7 shows a second embodiment of the present invention which differs from the first embodiment in that in stead of the tube 24 wound in a vortical form, a disk-shaped resilient container 30 containing a fluid 32 therein is housed in the recess 14 of the mounting head 12, and held within the recess of the mounting head 12 by means of a ring-shaped retainer 34 secured to the inner periphery of the mounting head 12. With this construction, the apparatus has the same advantages as the first embodiment exhibits.

Figure 8:
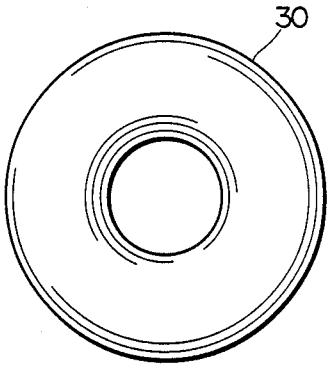
FIG. 8 is a view similar to FIG. 5, but showing a modified flexible container attached to the apparatus of FIG. 7.

In this embodiment, too, the resilient container 30 may be of a doughnut shape, as shown in FIG. 8, since no silicon wafer is disposed in the vicinity of the center of the mounting plate 20.

Figure 9:
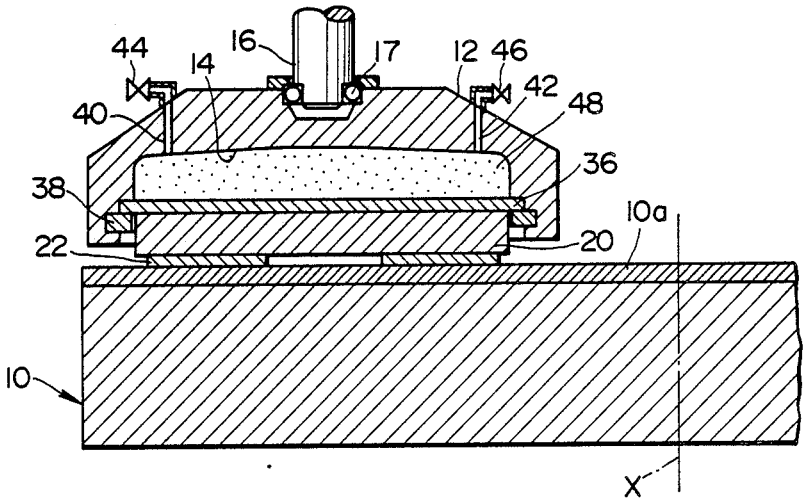
FIG. 9 is a view similar to FIG. 4, but showing another modified polishing apparatus in accordance with the present invention.

FIG. 9 shows a third embodiment of the present invention which differs from the above embodiments in that instead of a flexible tube or a container, a resilient diaphragm 36 is fixedly secured to the mounting head 12 by a retainer ring 38 so as to cover the recess thereof and disposed so as to be brought into contact with the upper face of the mounting plate 20. In this embodiment, the mounting head includes two through passageways 40 and 42 formed therethrough so as to open at its end to the recess 14, and two valves 44 and 46 are respectively connected to the passageways 40 and 42 through pipes. The recess 14 of the mounting head 12 and the diaphragm 36 cooperate with each other to define a chamber, and a fluid 48 is poured from the valve 44 through the passageway 40 into the chamber.

Although in the foregoing, the apparatus in accordance with the present invention is used for polishing silicon wafers, it may also be used for polishing a compound semiconductor wafer, a fused quartz and the like.

Further, while the polishing apparatuses according to the present invention have been specifically shown and described herein, many modifications and variations are possible in the light of the above teachings. It is therefore to be understood that within the scope of the appended claims, the invention may be practices otherwise than as specifically described.

What is claimed is:

1. An apparatus for polishing one of opposite faces of a slab member comprising:

(a) a surface plate having a flat upper surface and being rotatable about an axis perpendicular to said upper surface;

(b) a mounting member having an upper face and a lower face to which the other face of said slab member is fixedly secured, and said mounting member being disposed above said surface plate in such a manner that said one face of the slab member to be polished is held in contact with said upper surface of the surface plate;

(c) urging means operably connected to said mounting member for urging said mounting member toward said surface plate at a prescribed urging pressure to bring said one face of the slab member into pressure contact with said upper surface of said surface plate; and (d) pressure transmitting means interposed between said mounting member and said urging means for causing the urging pressure of said urging means to be exerted on said upper face of said mounting member, said transmitting means comprising a mounting head connected to said urging means and having a recess formed in a lower face thereof, and a flexible container containing a fluid therein and housed in said recess of said mounting head with an upper surface thereof being held in contact with an inner surface of said recess while a lower surface of said container is held in contact with said upper face of said mounting member;

said flexible container comprising an elongated tube having upper and lower faces and being wound in a vortical form and having opposite closed ends, said upper and lower faces of said elongated tube being secured by top and bottom seats of resilient material, respectively.

2. A polishing apparatus according to claim 1, in which said vortical elongated tube is of a doughnut shape.

* * * * *